US010852011B2

(12) United States Patent
Hara

(10) Patent No.: US 10,852,011 B2
(45) Date of Patent: Dec. 1, 2020

(54) HEAT EXCHANGER UNIT AND AIR-CONDITIONING APPARATUS

(71) Applicant: Mitsubishi Electric Corporation, Tokyo (JP)

(72) Inventor: Yuki Hara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 24 days.

(21) Appl. No.: 16/311,719

(22) PCT Filed: Aug. 24, 2016

(86) PCT No.: PCT/JP2016/074648
§ 371 (c)(1),
(2) Date: Dec. 20, 2018

(87) PCT Pub. No.: WO2018/037501
PCT Pub. Date: Mar. 1, 2018

(65) Prior Publication Data
US 2019/0203953 A1 Jul. 4, 2019

(51) Int. Cl.
*F24F 1/00* (2019.01)
*F24F 1/0059* (2019.01)
(Continued)

(52) U.S. Cl.
CPC ..... *F24F 1/0059* (2013.01); *F24F 1/0063* (2019.02); *F24F 1/26* (2013.01);
(Continued)

(58) Field of Classification Search
CPC ..... F28F 2280/00; F28F 2280/06; F28F 2280/04; F24F 13/20; F24F 13/30;
(Continued)

(56) References Cited

U.S. PATENT DOCUMENTS 2,883,161 A * 4/1959 Boylan ..... B60H 1/0005 165/43
3,834,683 A * 9/1974 McDuffee ..... F24F 3/14 261/138

(Continued)

FOREIGN PATENT DOCUMENTS

JP H02-137621 U 11/1990
JP 2003-240266 A 8/2003

(Continued)

OTHER PUBLICATIONS

International Search Report of the International Searching Authority dated Nov. 22, 2016 for the corresponding international application No. PCT/JP2016/074648 (and English translation).

*Primary Examiner* — Tho V Duong
(74) *Attorney, Agent, or Firm* — Posz Law Group, PLC

(57) ABSTRACT

A heat exchanger unit includes a heat exchanger, a drain pan, and a housing. The drain pan is a pullout drain pan capable of being pulled out sideways from the housing. A dew dripping space is formed between the heat exchanger and the outlet side surface of the housing, and in the dew dripping space, dew formed at the heat exchanger and blown off by an air flow drips into the drain pan due to its own weight before reaching the outlet of the housing. The heat exchanger unit further includes a fixing component by which the heat exchanger is fixed to the outlet side surface of the housing without interfering with the lateral movement of the drain pan and that forms the dew dripping space between the heat exchanger and the outlet side surface of the housing.

11 Claims, 5 Drawing Sheets

(51) Int. Cl.

| | |
|---|---|
| ***F24F 13/22*** | (2006.01) |
| ***F24F 1/0063*** | (2019.01) |
| ***F24F 13/30*** | (2006.01) |
| ***F24F 1/26*** | (2011.01) |

(52) U.S. Cl.
CPC ..... *F24F 13/22* (2013.01); *F24F 13/222* (2013.01); *F24F 13/30* (2013.01)

(58) Field of Classification Search
CPC ..... F24F 1/0063; F24F 13/22; F24F 1/0059; F24F 1/26; F24F 1/222; F25D 21/14

USPC ..... 248/300; 165/78
See application file for complete search history.

(56) References Cited

U.S. PATENT DOCUMENTS

| | | | | |
|---|---|---|---|---|
| 4,100,764 | A * | 7/1978 | Murano | F24F 1/04 62/262 |
| 4,747,275 | A * | 5/1988 | Amr | F24F 1/0022 62/419 |
| 5,237,831 | A * | 8/1993 | Sikora | F24F 13/30 165/86 |
| 5,437,164 | A * | 8/1995 | Consiglio | F24F 1/027 138/40 |
| 5,638,693 | A * | 6/1997 | Baek | F24F 13/20 62/262 |
| 2007/0113574 | A1* | 5/2007 | Davenport | F24F 13/224 62/285 |
| 2016/0265807 | A1* | 9/2016 | Platt | F24F 13/222 |

FOREIGN PATENT DOCUMENTS

| | | | |
|---|---|---|---|
| JP | 3802531 | B2 | 7/2006 |
| JP | 2008-275231 | A | 11/2008 |
| JP | 5865213 | B2 | 2/2016 |

* cited by examiner

HEAT EXCHANGER UNIT AND AIR-CONDITIONING APPARATUS

CROSS REFERENCE TO RELATED APPLICATION

This application is a U.S. national stage application of PCT/JP2016/074648 filed on Aug. 24, 2016, the contents of which are incorporated herein by reference.

TECHNICAL FIELD

The present invention relates to an air-conditioning apparatus and a heat exchanger unit that includes a heat exchanger and a pullout drain pan.

BACKGROUND ART

A conventional air-conditioning apparatus includes a drain pan in which dew formed at a heat exchanger or humidification water produced by a humidifier is accumulated as drain water. Usually, drain water that has flowed into the drain pan is spontaneously discharged from the drain pan to the outside due to the inclination of a drain pipe connected to the drain pan. Otherwise, the drain water is forcibly discharged from the drain pan to the outside by using a drain pump provided inside the air-conditioning apparatus.

A conventional heat exchanger unit such as a ceiling-embedded indoor unit is mounted on the drain pan with the drain pan disposed between the heat exchanger unit and a ceiling floor. Thus, to detach the drain pan, the heat exchanger unit needs to be lifted, which makes maintenance of the drain pan difficult.

Thus, techniques disclosed in Patent Literature 1 and 2 employ a pullout drain pan, and the pullout drain pan is housed inside a housing. In these techniques, the drain pan can be pulled out sideways from the housing, and it is not necessary to lift a heat exchanger unit. This facilitates maintenance of the drain pan.

CITATION LIST

Patent Literature

Patent Literature 1: Japanese Patent No. 5865213
Patent Literature 2: Japanese Patent No. 3802531

SUMMARY OF INVENTION

Technical Problem

For the conventional heat exchanger units disclosed in Patent Literature 1 and 2, since a heat exchanger is installed above a pullout drain pan to not interfere with the drain pan, the heat exchanger is attached to a stationary plate or is suspended.

In this instance, dew is blown off by an air flow that has been diverted around the heat exchanger without exchanging heat and reaches the outside of the heat exchanger unit. In addition, dew is blown off by an air flow that has undergone heat exchange at the heat exchanger and reaches the outside of the heat exchanger unit. Such blown-off dew reaching the outside of the heat exchanger unit results in the occurrence of mold or an undesirable effect, for example, corrosion of a component.

The present invention has been made to overcome the above problems, and an objective of the present invention is to provide a heat exchanger unit and an air-conditioning apparatus in which dew formed at a heat exchanger and blown off by an air flow drips into a drain pan, thereby suppressing the dew from reaching the outside of the heat exchanger unit.

Solution to Problem

A heat exchanger unit of an embodiment of the present invention includes: a heat exchanger; a drain pan provided below the heat exchanger; and a housing that houses the heat exchanger and the drain pan and that has an inlet side surface and an outlet side surface opposite to the inlet side surface with the heat exchanger disposed therebetween, the inlet side surface having an open inlet from which air flows into the heat exchanger, and the outlet side surface having an open outlet from which air that has undergone heat exchange flows out, in which the drain pan is a pullout drain pan capable of being pulled out sideways from the housing, a dew dripping space is formed between the heat exchanger and the outlet side surface of the housing, and in the dew dripping space, dew formed at the heat exchanger and blown off by an air flow drips into the drain pan due to its own weight before reaching the outlet, and the heat exchanger unit further includes a fixing component by which the heat exchanger is fixed to the outlet side surface of the housing without interfering with lateral movement of the drain pan and that forms the dew dripping space between the heat exchanger and the outlet side surface of the housing.

An air-conditioning apparatus of an embodiment of the present invention includes: the heat exchanger unit; and an air-sending device unit that accommodates an air-sending device, in which a refrigeration cycle circuit is formed by connecting a compressor, a heat-source-side heat exchanger, an expansion device, and the heat exchanger to each other by a pipe, and the air-sending device unit is provided on the upstream side of the heat exchanger unit in a direction of an air flow generated by the air-sending device.

Advantageous Effects of Invention

A heat exchanger unit and an air-conditioning apparatus of an embodiment of the present invention include a fixing component by which a heat exchanger is fixed to the outlet side surface of a housing without interfering with the lateral movement of a drain pan and that forms a dew dripping space between the heat exchanger and the outlet side surface of the housing. Accordingly, dew formed at the heat exchanger and blown off by an air flow drips into the drain pan, which can suppress the blown-off dew from reaching the outside of the heat exchanger unit.

BRIEF DESCRIPTION OF DRAWINGS

FIG. 10(*a*) illustrates a piece of sheet metal to be formed into the fixing component. FIG. 10(*b*) illustrates a state in which an opening is formed in the piece of sheet metal to be formed into the fixing component. FIG. 10(*c*) illustrates a state in which the piece of sheet metal to be formed into the fixing component is bent along a first straight line, thereby forming a first bent portion. FIG. 10(*d*) illustrates a state in which the piece of sheet metal to be formed into the fixing component is bent along a second straight line, thereby forming a second bent portion. FIG. 10(*e*) illustrates a state in which screw holes are formed in the piece of sheet metal to be formed into the fixing component.

DESCRIPTION OF EMBODIMENT

Figure 1:
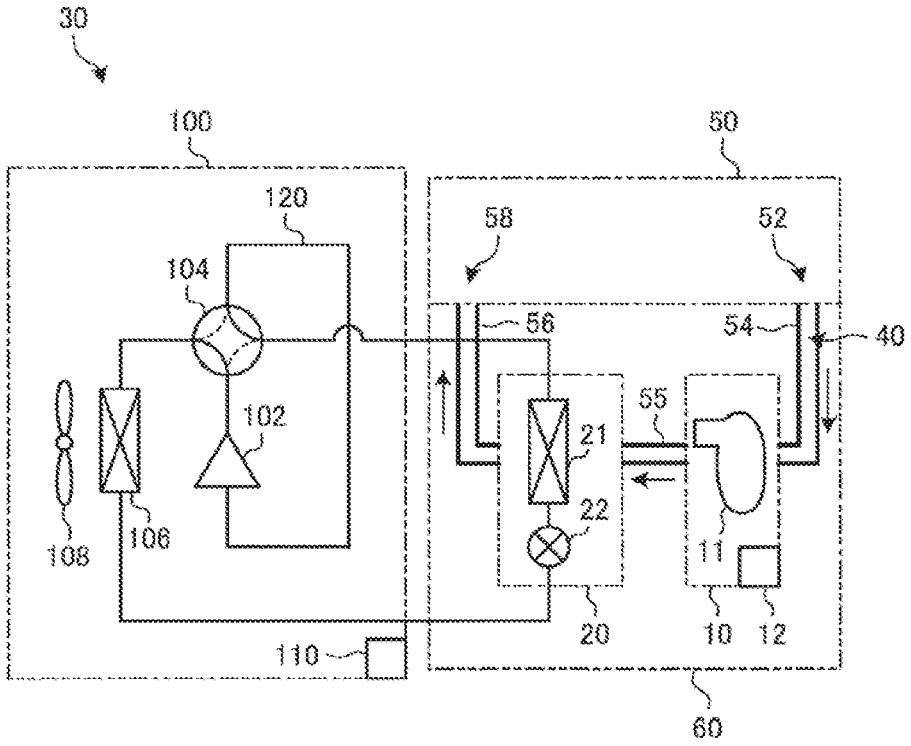
FIG. 1 schematically illustrates a configuration example of an air-conditioning apparatus according to an embodiment of the present invention.

Hereinafter, an embodiment of the present invention is described with reference to the Drawings.

It should be noted that components to which the same reference symbols are assigned in the Drawings are identical or equivalent components throughout the specification.

In addition, exemplified constituent components described throughout the specification are mere exemplifications, and the constituent components are not limited to such descriptions.

Embodiment

Figure 2:
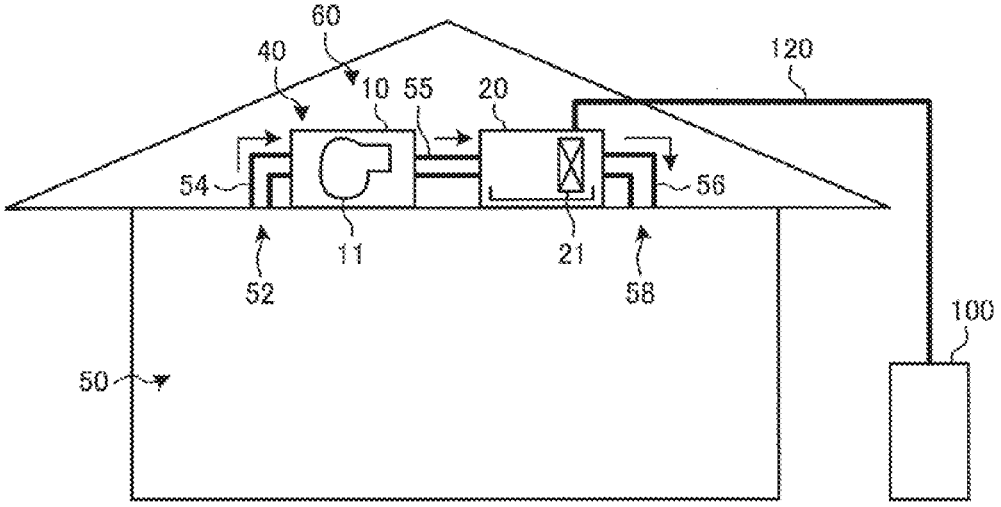
FIG. 2 schematically illustrates an example of the arrangement of an air-sending device unit, a target air heat exchanger unit, and a heat-source-side unit in the air-conditioning apparatus according to the embodiment of the present invention.

FIG. 1 schematically illustrates a configuration example of an air-conditioning apparatus 30 according to an embodiment of the present invention. FIG. 2 schematically illustrates an example of the arrangement of an air-sending device unit 10, a target air heat exchanger unit 20, and a heat-source-side unit 100 in the air-conditioning apparatus 30 according to the embodiment of the present invention.

The air-conditioning apparatus 30 shown in FIG. 1 conditions the air in an air-conditioned room 50 such as a room inside a building or house. The air-conditioning apparatus 30 is, for example, used as a ceiling-embedded air-conditioning apparatus such as a packaged home air-conditioning apparatus or a building multi-air-conditioning apparatus.

The air-conditioning apparatus 30 has a refrigeration cycle circuit in which the target air heat exchanger unit 20 and the heat-source-side unit 100 are connected to each other by a refrigerant pipe 120, thereby circulating refrigerant.

Here, the target air heat exchanger unit 20 corresponds to a heat exchanger unit in the present invention.

The heat-source-side unit 100 is, for example, installed outdoors. The heat-source-side unit 100 includes a compressor 102, a flow-switching device 104, a heat-source-side heat exchanger 106, and a controller 110. The heat-source-side unit 100 also includes an air-sending device 108 for sending air to the heat-source-side heat exchanger 106.

The compressor 102 compresses refrigerant flowing through the refrigerant pipe 120. The flow-switching device 104 changes the direction in which the refrigerant flows through the refrigerant pipe 120 in accordance with whether the air-conditioning apparatus 30 is operating in cooling mode or heating mode. The heat-source-side heat exchanger 106 exchanges heat between the outdoor air and the refrigerant flowing through the refrigerant pipe 120. The controller 110 controls the entirety of the air-conditioning apparatus 30. The controller 110 has a microcontroller including, for example, a CPU, ROM, RAM, and I/O ports.

The target air heat exchanger unit 20 is, for example, installed in an equipment space 60 inside a building or a house. The equipment space 60 is, for example, a space above the ceiling of the air-conditioned room 50 inside a building or a house. That is, the target air heat exchanger unit 20 is installed above the ceiling.

The target air heat exchanger unit 20 includes an expansion device 22 and a target air heat exchanger 21. The expansion device 22 controls the pressure of the refrigerant flowing through the refrigerant pipe 120. It should be noted that the heat-source-side unit 100 rather than the target air heat exchanger unit 20 may accommodate the expansion device 22. The target air heat exchanger 21 exchanges heat between the refrigerant flowing through the refrigerant pipe 120 and target air obtained by causing the room air in the air-conditioned room 50 to flow into the air duct 40. The target air heat exchanger 21 corresponds to a heat exchanger in the present invention.

The air-conditioning apparatus 30 also includes the air-sending device unit 10. The air-sending device unit 10 is, for example, installed in the equipment space 60. That is, together, the air-sending device unit 10 and the target air heat exchanger unit 20 are installed above the ceiling. The air-sending device unit 10 includes a sirocco fan 11 serving as an air-sending device, a motor (not shown) that rotationally drives the sirocco fan 11, and a controller 12 that controls the rotation speed of the motor. The controller 12 has a microcontroller including, for example, a CPU, ROM, RAM, and I/O ports.

It should be noted that as an air-sending device, the air-sending device unit 10 may accommodate, for example, a propeller fan or fans of other types instead of the sirocco fan.

The air-conditioned room 50 and the air-sending device unit 10 communicate with each other via a duct 54. The air-sending device unit 10 and the target air heat exchanger unit 20 communicate with each other via a duct component 55. The target air heat exchanger unit 20 and the air-conditioned room 50 communicate with each other via a duct 56. The target air flowing out from the target air heat exchanger unit 20 flows through the duct 56. The duct 56 extends up to the top of the air-conditioned room 50 in which the air inside a building or a house is conditioned.

The duct component 55 and the two ducts, the duct 54 and the duct 56, are, for example, flexible ducts.

The duct component 55, the two ducts, the duct 54 and the duct 56, the air-sending device unit 10, and the target air heat exchanger unit 20 constitute the air duct 40 through which the target air, which is obtained by causing the room air in the air-conditioned room 50 to flow into the air duct 40, flows. The air duct 40 is provided in the equipment space 60. That is, the air duct 40 extends above the ceiling in a building or a house. The air-sending device unit 10, the duct component 55, and the target air heat exchanger unit 20 are provided between the inlet and outlet of the air duct 40.

The air-sending device unit 10 is provided on the upstream side of the target air heat exchanger unit 20 in the direction of the air flow generated by the sirocco fan 11 in the air duct 40.

When the air-sending device unit 10 operates, the air in the air-conditioned room 50 is sucked into the duct 54 via a suction port 52, which is the inlet of the air duct 40. The target air sucked into the duct 54 flows into the target air heat exchanger unit 20 via the air-sending device unit 10 and the duct component 55.

The target air heat exchanger 21 exchanges heat between refrigerant and the target air that has flowed into the target air heat exchanger unit 20. The air-conditioned air obtained as a result of heat exchange in the target air heat exchanger 21 flows through the duct 56 and is blown into the air-conditioned room 50 from an air outlet 58, which is the outlet of the air duct 40.

Figure 3:
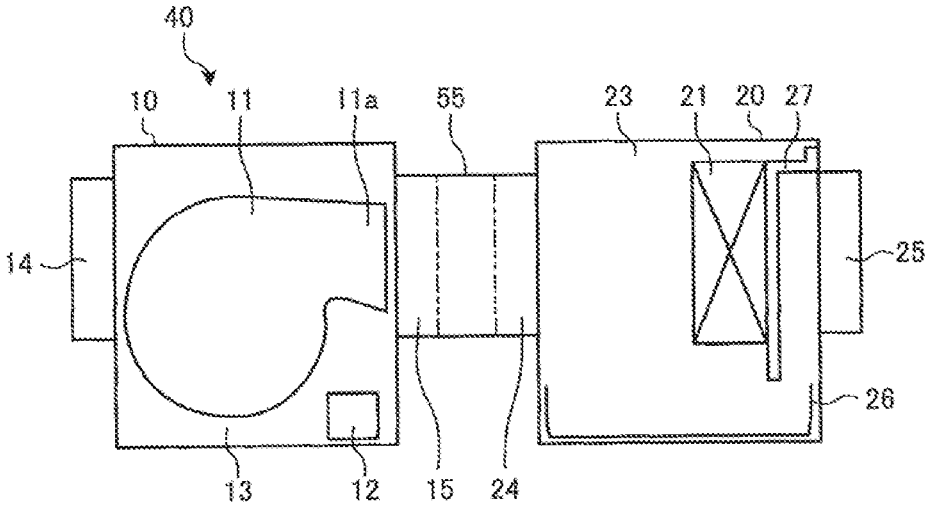
FIG. 3 schematically illustrates a configuration example of the air-sending device unit and the target air heat exchanger unit according to the embodiment of the present invention.

FIG. 3 schematically illustrates a configuration example of the air-sending device unit 10 and the target air heat exchanger unit 20 according to the embodiment of the present invention.

As shown in FIG. 3, the duct component 55 connects the air-sending device unit 10 and the target air heat exchanger unit 20 to each other.

The duct component 55 is, for example, a flexible duct. Thus, the duct component 55 is bendable or extendable, thereby increasing the flexibility of the arrangement of the air-sending device unit 10 and the target air heat exchanger unit 20.

The air-sending device unit 10 is provided on the upstream side of the target air heat exchanger unit 20 in the direction of the air flow generated by the sirocco fan 11 in the air duct 40.

It should be noted that as the duct component 55, a duct component connectable to a flange 15 of a unit housing 13 in the air-sending device unit 10 and a flange 24 of a unit housing 23 in the target air heat exchanger unit 20 can be used. The air-sending device unit 10 or the target air heat exchanger unit 20 may have an integral duct component 55.

Here, if the air-sending device unit 10 and the target air heat exchanger unit 20 can be attached to each other and detached from each other by using the duct component 55, there is an improvement in the flexibility of the arrangement of the air-sending device unit 10 and the target air heat exchanger unit 20 and work efficiency when installing these units.

The distance between the air-sending device unit 10 and the target air heat exchanger unit 20 is less than the width of the unit housing 13 in the air-sending device unit 10 and the width of the unit housing 23 in the target air heat exchanger unit 20, in the direction of air flow. That is, the distance between the air-sending device unit 10 and the target air heat exchanger unit 20 in the direction of air flow is from 70 mm to 100 mm, inclusive. In addition, the width of the unit housing 13 in the air-sending device unit 10 and the width of the unit housing 23 in the target air heat exchanger unit 20, in the direction of air flow are equal to or less than 550 mm.

Figure 4:
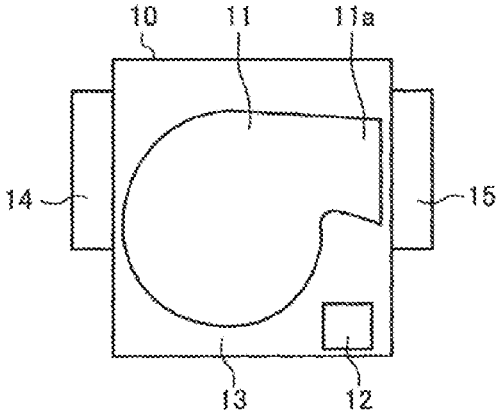
FIG. 4 schematically illustrates a configuration example of the air-sending device unit according to the embodiment of the present invention.

FIG. 4 schematically illustrates a configuration example of the air-sending device unit 10 according to the embodiment of the present invention.

The air-sending device unit 10 has the unit housing 13, which is a cuboidal box.

The air-sending device unit 10 has a flange 14 in a portion where the air-sending device unit 10 connects to the duct 54, on the upstream side of the air-sending device unit 10 in the direction of air flow in the air duct 40. The flange 14 protrudes from the unit housing 13 and is hollow inside. The air-sending device unit 10 has a flange 15 in a portion where the air-sending device unit 10 connects to the duct component 55, on the downstream side of the air-sending device unit 10 in the direction of air flow in the air duct 40. The flange 15 protrudes from the unit housing 13 and is hollow inside.

The flange 14 and the flange 15 protrude from the side surfaces of the unit housing 13 in the air-sending device unit 10 so as to form square tubes. Thus, an area surrounded by the periphery of the flange 14, an area surrounded by the periphery of the flange 15, an area surrounded by the periphery of the duct 54 connected to the flange 14, and an area surrounded by the periphery of the duct component 55 connected to the flange 15 are each smaller than corresponding one of the area of the side surface, from which the flange 14 protrudes, of the unit housing 13 in the air-sending device unit 10 and the area of the side surface, from which the flange 15 protrudes, of the unit housing 13 in the air-sending device unit 10.

The flange 14 and the flange 15 are provided so that the centers of the flange 14 and the flange 15 are above the centers of the side surfaces, from which the flange 14 and the flange 15 protrude, of the unit housing 13 in the air-sending device unit 10. This enables the sirocco fan 11 to efficiently send air. Here, a direction in which air is discharged from an air-sending port 11*a* positioned in an upper portion of the unit housing 13 is a lateral direction.

As shown in FIG. 4, the air-sending device unit 10 has the sirocco fan 11 as an air-sending device. The air-sending port 11*a* of the sirocco fan 11 faces the side surface of the unit housing 13 in the air-sending device unit 10 on the downstream side in the direction of air flow in the air duct 40 and is positioned in the upper portion of the unit housing 13 in the air-sending device unit 10. The sirocco fan 11 is placed so that the direction in which the air-sending port 11*a* sends air is the lateral direction. Even if the unit housing 13 houses the sirocco fan 11, the air-sending device unit 10 is provided on the upstream side of the target air heat exchanger unit 20 in the direction of air flow in the air duct 40. Thus, dew formed at the target air heat exchanger 21 does not adversely affect the sirocco fan 11, and consequently waterproofing treatment can be simplified.

The air-sending device unit 10 also includes the controller 12 inside the unit housing 13. The controller 12 communicates with the controller 110 in the heat-source-side unit 100 and controls the rotation speed of the motor of the sirocco fan 11. Even if the unit housing 13 houses the controller 12, the air-sending device unit 10 is provided on the upstream side of the target air heat exchanger unit 20 in the direction of air flow in the air duct 40. Thus, dew formed at the target air heat exchanger 21 does not adversely affect the controller 12, and consequently waterproofing treatment can be simplified.

Figure 5:
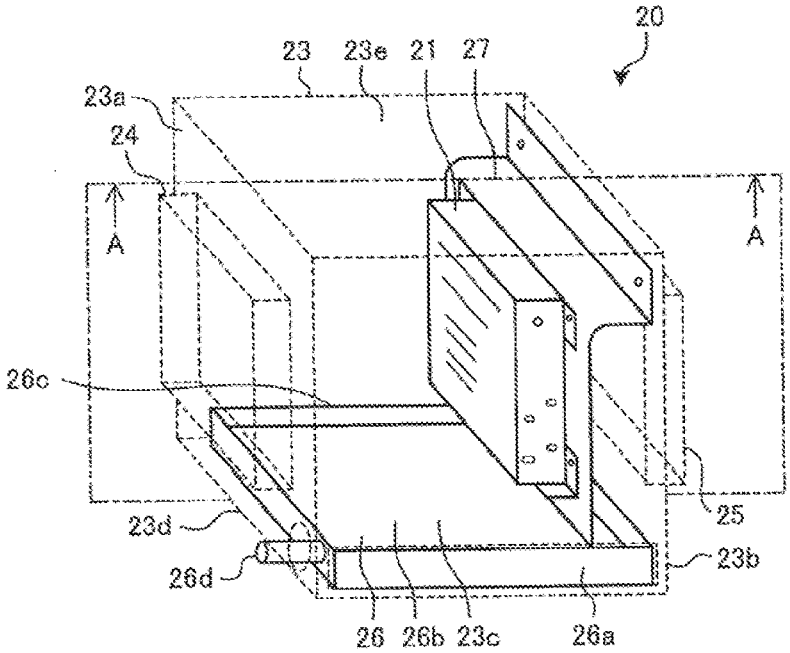
FIG. 5 is a partially transparent perspective view illustrating a configuration example of the target air heat exchanger unit according to the embodiment of the present invention.

FIG. 5 is a partially transparent perspective view illustrating a configuration example of the target air heat exchanger unit 20 according to the embodiment of the present invention.

The air-sending device unit 20 has the unit housing 23, which is a cuboidal box. The unit housing 23 corresponds to the housing of the heat exchanger unit in the present invention.

The unit housing 23 houses the target air heat exchanger 21.

The target air heat exchanger unit 20 has the flange 24 in a portion where the target air heat exchanger unit 20 connects to the duct component 55, on the upstream side in the direction of air flow in the air duct 40. The flange 24 protrudes from the unit housing 23 and is hollow inside. The target air heat exchanger unit 20 has a flange 25 in a portion where the target air heat exchanger unit 20 connects to the duct 56, on the downstream side in the direction of air flow in the air duct 40. The flange 25 protrudes from the unit housing 23 and is hollow inside.

That is, the unit housing 23 has an inlet side surface 23*a* having an open inlet surrounded by the flange 24, from which the target air flows into the target air heat exchanger 21. The unit housing 23 also has an outlet side surface 23*b* opposite to the inlet side surface 23*a* with the target air heat exchanger 21 disposed therebetween. The outlet side surface 23*b* has an open outlet surrounded by the flange 25, from which the target air that has undergone heat exchange flows out.

The flange 24 and the flange 25 protrude from the inlet side surface 23*a* and the outlet side surface 23*b*, respectively, of the unit housing 23 in the target air heat exchanger unit 20 so as to form square tubes. Thus, an area surrounded by the periphery of the flange 24, an area surrounded by the periphery of the flange 25, an area surrounded by the periphery of the duct component 55 connected to the flange 24, and an area surrounded by the periphery of the duct 56 connected to the flange 25 are each smaller than corresponding one of the area of the inlet side surface 23*a*, from which the flange 24 protrudes, of the unit housing 23 in the target air heat exchanger unit 20 and the area of the outlet side surface 23*b*, from which the flange 25 protrudes, of the unit housing 23 in the target air heat exchanger unit 20.

The flange 24 is provided so that the center of the flange 24 is above the center of the inlet side surface 23*a*, from which the flange 24 protrudes, of the unit housing 23 in the target air heat exchanger unit 20. The flange 25 is provided so that the center of the flange 25 is above the center of the outlet side surface 23*b*, from which the flange 25 protrudes, of the unit housing 23 in the target air heat exchanger unit 20. This enables the sirocco fan 11 to efficiently send air to the target air heat exchanger unit 20.

Here, as shown in FIG. 3, the duct component 55 connects the flange 15 of the air-sending device unit 10 and the flange 24 of the target air heat exchanger unit 20 to each other, and the duct component 55 connects to both the flange 15 and the flange 24 so that the center of the duct component 55 is above the center of the outlet side surface 23*b*, from which the flange 15 protrudes, of the unit housing 13 in the air-sending device unit 10 and the center of the inlet side surface 23*a*, from which the flange 24 protrudes, of the unit housing 23 in the target air heat exchanger unit 20. Accordingly, the duct component 55 can avoid interfering with an obstacle below the duct component 55.

Figure 6:
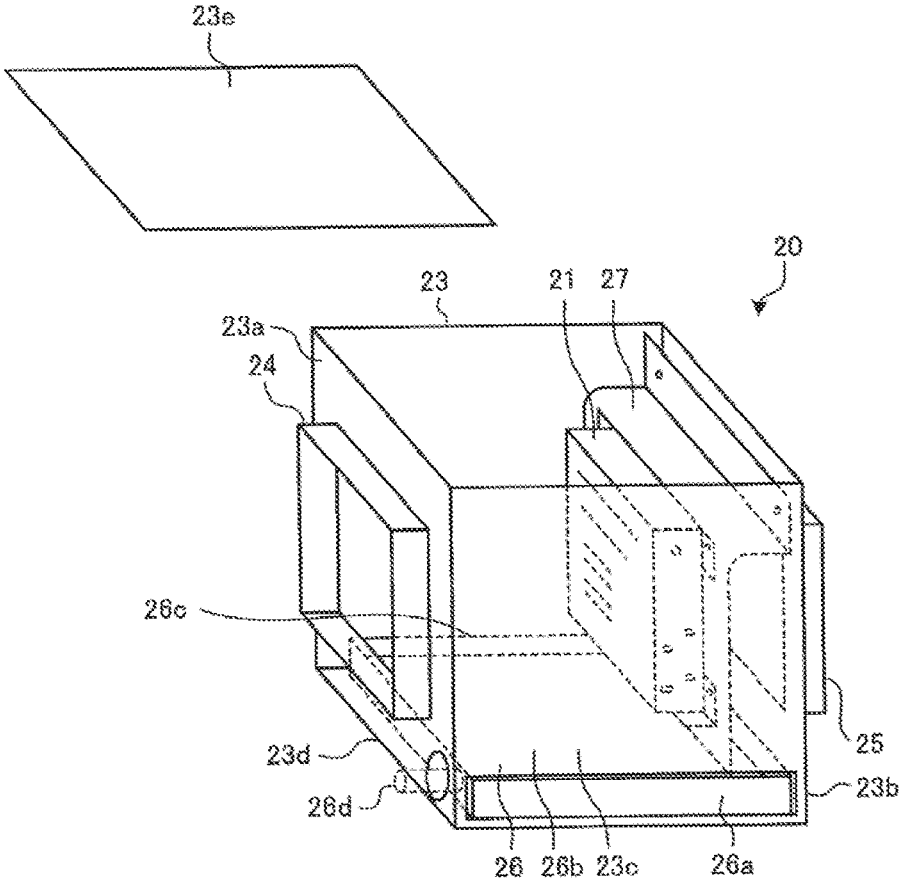
FIG. 6 is a partially transparent perspective view illustrating a state in which the top plate of the target air heat exchanger unit according to the embodiment of the present invention is removed.

FIG. 6 is a partially transparent perspective view illustrating a state in which a top plate 23*e* is removed from the target air heat exchanger unit 20 according to the embodiment of the present invention.

The top plate 23*e* is a separate component of the unit housing 23. That is, the top plate 23*e* of the unit housing 23 is detachable so as to enable an operator to remove the top plate 23*e* and perform maintenance inside the target air heat exchanger unit 20.

When the top plate 23*e* is detached from the unit housing 23, the entire top of the unit housing 23 is open. This facilitates maintenance by enabling an operator to put his or her hands into the top opening of the unit housing 23 from which the top plate 23*e* is removed.

As shown in FIG. 5, in the target air heat exchanger unit 20, the inner bottom of the unit housing 23 has a plate-shaped drain pan 26 for receiving dew formed at the target air heat exchanger 21. The drain pan 26 is provided below the target air heat exchanger 21. That is, the unit housing 23 houses the drain pan 26 as a separate component.

The drain pan 26 is a pullout drain pan capable of being pulled out sideways from a right side surface 23*c* of the unit housing 23 provided between the inlet side surface 23*a* and the outlet side surface 23*b*. Thus, the right side surface 23*c* of the unit housing 23 has an opening from which the drain pan 26 can be pulled out. The opening of the right side surface 23*c* is closeable by a right side wall 26*a* of the drain pan 26.

A water receiving surface 26*b* of the drain pan 26 is larger than a projection region obtained when the target air heat exchanger 21 is projected from above onto a plane inside the unit housing 23. The water receiving surface 26*b* is across the entire surface of the bottom surface 23*d* of the unit housing 23. The water receiving surface 26*b* of the drain pan 26 is inclined downward from a left side surface 26*c* toward the right side wall 26*a*.

A drain hose 26*d* detachably connects to a portion of the water receiving surface 26*b* at the lowest position, on the side where the right side wall 26*a* of the drain pan 26 is present. By using the drain hose 26*d*, drain water accumulated in the drain pan 26 is discharged to the outside of the drain pan 26. The drain hose 26*d* passes through a through hole formed in the inlet side surface 23*a* of the unit housing 23 and extends to the outside of the target air heat exchanger unit 20.

By removing the drain hose 26*d* from the drain pan 26, the drain pan 26 can be pulled out sideways from the unit housing 23.

The target air heat exchanger unit 20 has a fixing component 27 by which the target air heat exchanger 21 is fixed to the outlet side surface 23*b* of the unit housing 23 without interfering with the lateral movement of the drain pan 26. Thus, the fixing component 27 enables the target air heat exchanger 21 to be suspended above the drain pan 26, which is a pullout drain pan.

The target air heat exchanger 21 installed in the fixing component 27 is longer than it is wide so that the direction in which air flows through the target air heat exchanger 21 is identical to the horizontal direction.

Figure 7:
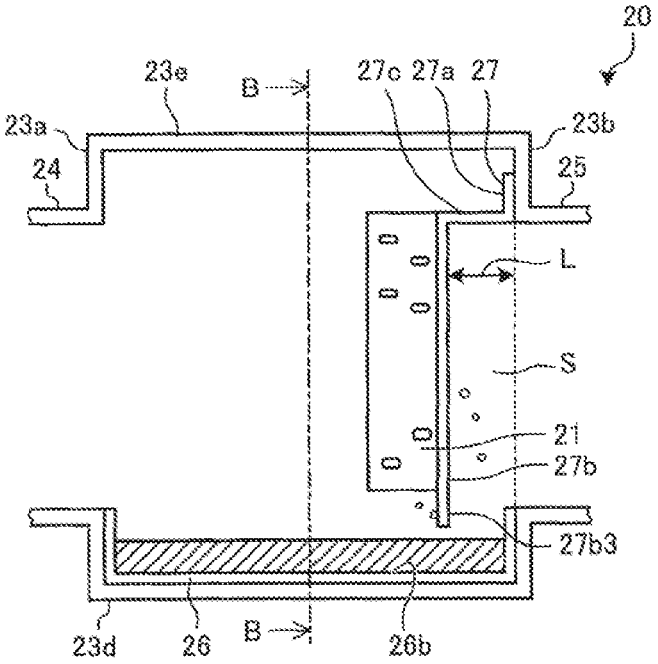
FIG. 7 illustrates a cross-section of the target air heat exchanger unit according to the embodiment of the present invention taken along plane A-A shown in FIG. 5 to explain the configuration of the target air heat exchanger unit.

FIG. 7 illustrates a cross-section of the target air heat exchanger unit 20 according to the embodiment of the present invention taken along plane A-A shown in FIG. 5 to explain the configuration of target air heat exchanger unit 20.

As shown in FIG. 7, the fixing component 27 forms, between the target air heat exchanger 21 and the outlet side surface 23*b* of the unit housing 23, a dew dripping space S having a setting width L.

In the dew dripping space S between the target air heat exchanger 21 and the outlet side surface 23*b* of the unit housing 23, dew formed at the target air heat exchanger 21 and blown off by an air flow drips into the drain pan 26 due to its own weight before reaching the outlet surrounded by the flange 25.

Here, the setting width L of the dew dripping space S is equal to the width of the dew dripping space S in the direction of air flow, and the setting width L is from 5 cm to 15 cm, inclusive. If the setting width L is equal to or greater than 5 cm, blown-off dew does not reach the outside of the target air heat exchanger unit 20. If the setting width L is equal to or less than 15 cm, it is possible to downsize the target air heat exchanger unit 20 while obtaining an effect of suppressing blown-off dew from reaching the outside of the target air heat exchanger unit 20.

It should be noted that a not-shown drain pump or a not-shown connection pipe connected to the target air heat exchanger 21 is provided between the target air heat exchanger 21 and the inlet side surface 23*a* of the unit housing 23. Thus, in FIG. 7, the space between the target air heat exchanger 21 and the inlet side surface 23*a* of the unit housing 23 is larger than the dew dripping space S.

Figure 8:
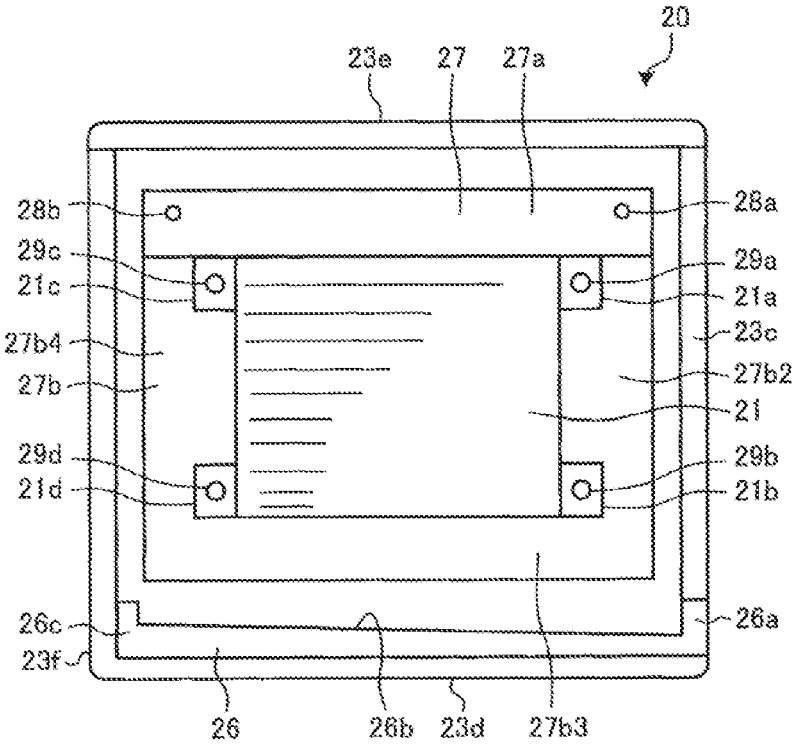
FIG. 8 illustrates a cross-section of the target air heat exchanger unit according to the embodiment of the present invention taken along line B-B shown in FIG. 7 to explain the configuration of the target air heat exchanger unit.
Figure 9:
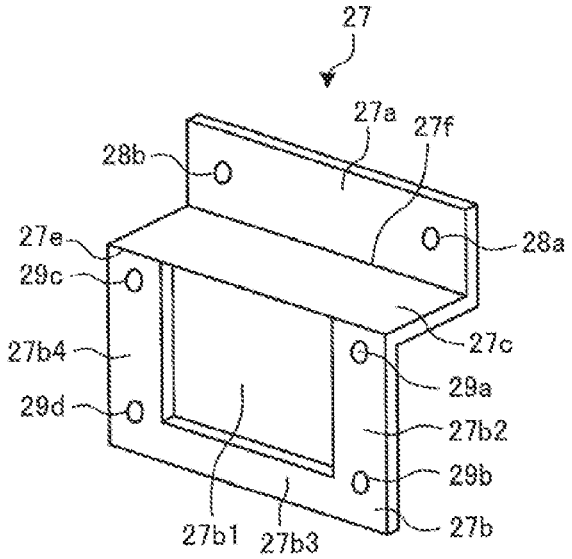
FIG. 9 is a perspective view of a fixing component in the target air heat exchanger unit according to the embodiment of the present invention.
Figure 10:
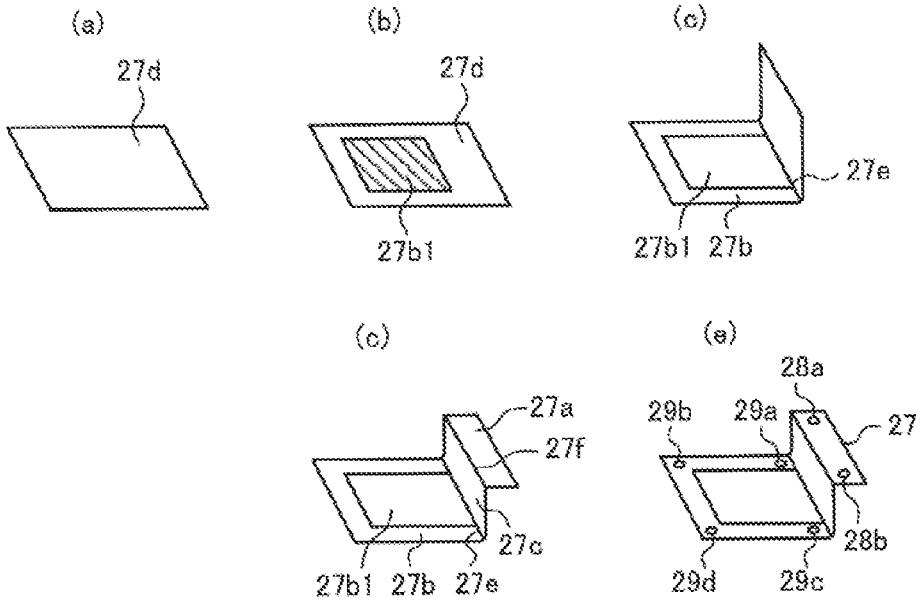
FIG. 10 illustrates the whole process of manufacturing the fixing component in the target air heat exchanger unit according to the embodiment of the present invention.

FIG. 8 illustrates a cross-section of the target air heat exchanger unit 20 according to the embodiment of the present invention taken along line B-B shown in FIG. 7 to explain the configuration of the target air heat exchanger unit 20. FIG. 9 is a perspective view of the fixing component 27 in the target air heat exchanger unit 20 according to the embodiment of the present invention. FIG. 10 illustrates the whole process of manufacturing the fixing component 27 in the target air heat exchanger unit 20 according to the embodiment of the present invention. FIG. 10(*a*) illustrates a piece of sheet metal 27*d* to be formed into the fixing component 27. FIG. 10(*b*) illustrates a state in which an opening 27*b*1 is formed in the piece of sheet metal 27*d* to be formed into the fixing component 27. FIG. 10(*c*) illustrates a state in which the piece of sheet metal 27*d* to be formed into the fixing component 27 is bent along a first straight line, thereby forming a first bent portion 27*e*. FIG. 10(*d*) illustrates a state in which the piece of sheet metal 27*d* to be formed into the fixing component 27 is bent along a second straight line, thereby forming a second bent portion 27*f*. FIG. 10(*e*) illustrates a state in which a screw hole 28*a*, a screw hole 28*b*, a screw hole 29*a*, a screw hole 29*b*, a screw hole 29*c*, and a screw hole 29*d* are formed in the piece of sheet metal 27*d* to be formed into the fixing component 27.

As shown in FIGS. 7 to 10, the fixing component 27 has an attachment portion 27*a*, a heat exchanger placement portion 27*b*, and a laterally extending portion 27*c*.

The flat surface of the attachment portion 27*a* of the fixing component 27 is attached to the outlet side surface 23*b* of the unit housing 23. The attachment portion 27*a* is screwed by engaging, in a threaded manner, screws in the screw hole 28*a* and the screw hole 28*b* formed in two portions on the right and left sides of the attachment portion 27*a*.

When attaching the attachment portion 27*a*, as shown in FIG. 6, an operator can put his or her hands into the top opening of the unit housing 23 from which the top plate 23*e* is removed and screw, by using a tool, the attachment portion 27*a*, which extends upward from the laterally extending portion 27*c*, to the outlet side surface 23*b* of the unit housing 23 under the top opening of the unit housing 23. It should be noted that before attaching the attachment portion 27*a* to the outlet side surface 23*b* of the unit housing 23, the target air heat exchanger 21 is attached to the fixing component 27.

It should be noted that instead of attaching the attachment portion 27*a* by screwing, the attachment portion 27*a* may be attached in various ways, for example, by welding, soldering, or bonding.

The target air heat exchanger 21 is placed in the heat exchanger placement portion 27*b* of the fixing component 27. The plate surface of the heat exchanger placement portion 27*b* is vertical.

As shown in FIG. 9, the heat exchanger placement portion 27*b* has the rectangular opening 27*b*1 whose periphery matches the periphery of the rectangular target air heat exchanger 21. Target air that is to undergo heat exchange flows through the opening 27*b*1 in the heat exchanger placement portion 27*b*.

As shown in FIG. 8, the target air heat exchanger 21 has two holding portions at the top and bottom on each side, that is, a holding portion 21*a*, a holding portion 21*b*, a holding portion 21*c*, and a holding portion 21*d*. By engaging screws in the screw hole 29*a*, the screw hole 29*b*, the screw hole 29*c*, and the screw hole 29*d* in a threaded manner, the four holding portions, the holding portion 21*a*, the holding portion 21*b*, the holding portion 21*c*, and the holding portion 21*d* are screwed to the heat exchanger placement portion 27*b* so that the target air heat exchanger 21 closes the opening 27*b*1 in the heat exchanger placement portion 27*b*.

Before attachment of the fixing component 27 to the unit housing 23, the target air heat exchanger 21 is screwed to only the fixing component 27.

It should be noted that instead of attaching the target air heat exchanger 21 by screwing, the target air heat exchanger 21 may be attached in various ways, for example, by welding, soldering, or bonding.

As shown in FIGS. 8 and 9, the heat exchanger placement portion 27*b* has a right peripheral portion 27*b*2, a bottom peripheral portion 27*b*3, and a left peripheral portion 27*b*4 that are portions around the opening 27*b*1 formed in the heat exchanger placement portion 27*b* and that extend around the target air heat exchanger 21.

As shown in FIG. 8, the right peripheral portion 27*b*2 is adjacent to the right side surface 23*c* of the unit housing 23, the bottom peripheral portion 27*b*3 is adjacent to the drain pan 26, and the left peripheral portion 27*b*4 is adjacent to a left side surface 23*f* of the unit housing 23, such that gaps formed therebetween are small. Thus, since the right peripheral portion 27*b*2, the bottom peripheral portion 27*b*3, and the left peripheral portion 27*b*4 around the opening 27*b*1 formed in the heat exchanger placement portion 27*b* extend around the target air heat exchanger 21, the flow of air being diverted around the target air heat exchanger 21 without exchanging heat is weakened.

The laterally extending portion 27*c* of the fixing component 27 extends laterally between the attachment portion 27*a* and the heat exchanger placement portion 27*b* so as to form the dew dripping space S. That is, as shown in FIG. 7, the length of the laterally extending portion 27*c* is equal to the setting width L of the dew dripping space S. and the laterally extending portion 27*c* extends horizontally in a straight line from one side to the other. Moreover, the laterally extending portion 27*c* extends laterally from one side to the other above the target air heat exchanger 21.

It should be noted that the laterally extending portion 27*c* does not have to extend horizontally in a straight line from one side to the other as long as the laterally extending portion 27*c* extends laterally between the attachment portion 27*a* and the heat exchanger placement portion 27*b* so as to form the dew dripping space S. The laterally extending portion may be curved or bent or extend obliquely from one side to the other. The laterally extending portion may be made of portions extending laterally from one side to the other on both the right and left sides of the target air heat exchanger above the target air heat exchanger.

Here, the attachment portion 27*a*, the heat exchanger placement portion 27*b*, and the laterally extending portion 27*c* of the fixing component 27 are made of the piece of sheet metal 27*d* having a rectangular shape.

The process of manufacturing the fixing component 27 is described below.

As shown in FIG. 10(*a*), the fixing component 27 is made of the piece of sheet metal 27*d* having a rectangular shape.

As shown in FIG. 10(*b*), the rectangular opening 27*b*1 is formed in the piece of sheet metal 27*d* so as to form the rectangular opening 27*b*1 in the heat exchanger placement portion 27*b* of the fixing component 27.

As shown in FIG. 10(*c*), to form the first bent portion 27*e*, the fixing component 27 is bent between the heat exchanger placement portion 27*b* and the laterally extending portion 27*c* at an angle of 90 degrees along the first straight line in the direction orthogonal to the direction of air flow. The position of the first bent portion 27*e* is identical to that of the top periphery of the rectangular opening 27*b*1 in the heat exchanger placement portion 27*b*.

As shown in FIG. 10(*d*), to form the second bent portion 27*f*, the fixing component 27 is bent between the laterally extending portion 27*c* and the attachment portion 27*a* at an angle of 90 degrees along the second straight line in the direction orthogonal to the direction of air flow. Here, the fixing component 27 is bent in the direction opposite to the direction in which the first bent portion 27*e* is bent. In the embodiment, the length of the laterally extending portion 27*c* is equal to the setting width L of the dew dripping space S. Thus, the distance between the first bent portion 27*e* and the second bent portion 27*f* corresponds to the length of the laterally extending portion 27*c*, that is, the setting width L of the dew dripping space S. In addition, the laterally extending portion 27*c* is a straight-line portion extending horizontally and laterally from one side to the other. Thus, the height of the top periphery of the outlet surrounded by the flange 25 is set to be equal to that of the top side of the periphery of the opening 27*b*1 in the heat exchanger placement portion 27*b*.

As shown in FIG. 10(*e*), the screw hole 28*a*, the screw hole 28*b*, the screw hole 29*a*, the screw hole 29*b*, the screw hole 29*c*, and the screw hole 29*d* are formed at required positions in the fixing component 27. It should be noted that these screw holes may be formed in an unprocessed piece of sheet metal. If the target air heat exchanger 21 is not screwed to the fixing component, it is not necessary to form screw holes.

By manufacturing the fixing component 27 in this way, the state of the fixing component 27 shown in FIG. 9 is obtained. That is, the piece of sheet metal 27*d* is used to make the fixing component 27. The fixing component 27 has the opening 27*b*1 formed in the heat exchanger placement portion 27*b*. The fixing component 27 has the first bent portion 27*e* bent between the heat exchanger placement portion 27*b* and the laterally extending portion 27*c* at an angle of 90 degrees along the first straight line in the direction orthogonal to the direction of air flow. The fixing component 27 has the second bent portion 27*f* bent between the laterally extending portion 27*c* and the attachment portion 27*a* at an angle of 90 degrees along the second straight line in the direction orthogonal to the direction of air flow. Here, the second bent portion 27*f* is bent in the direction opposite to the direction in which the first bent portion 27*e* is bent.

Here, as shown in FIG. 7, the first bent portion 27*e*, which is bent between the heat exchanger placement portion 27*b* and the laterally extending portion 27*c* of the fixing component 27, corresponds to the top periphery of the opening 27*b*1 in the heat exchanger placement portion 27*b*.

The second bent portion 27*f*, which is bent between the laterally extending portion 27*c* and the attachment portion 27*a* of the fixing component 27, corresponds to the top periphery of the outlet surrounded by the flange 25, the top periphery of the outlet having the same height as the top side of the periphery of the opening 27*b*1 in the heat exchanger placement portion 27*b*.

Thus, the laterally extending portion 27*c*, which extends from one side to the other horizontally in a straight line, extends laterally from one side to the other above the target air heat exchanger 21. Accordingly, an air flow that is to be diverted around and flow above the target heat exchanger 21 is not generated although such an air flow is likely to blow off dew over a long distance.

As shown in FIG. 7, because of the provision of the second bent portion 27*f* bent in the direction opposite to the direction in which the first bent portion 27*e* is bent, the attachment portion 27*a* of the fixing component 27 extends upward from an end portion of the laterally extending portion 27*c* on the downstream side in the direction of air flow and is screwed under the top opening of the unit housing 23 from which the top plate 23*e* is removed. That is, an operator can put his or her hands into the top opening of the unit housing 23 from which the top plate 23*e* is removed and fix the attachment portion 27*a* extending upward from the laterally extending portion 27*c* to the outlet side surface 23*b* of the unit housing 23 under the top opening of the unit housing 23.

Meanwhile, as shown in FIG. 7, because of the provision of the first bent portion 27*e*, the heat exchanger placement portion 27*b* of the fixing component 27 extends downward from an end portion of the laterally extending portion 27*c* on the upstream side in the direction of air flow, and relative to the direction of air flow, the target air heat exchanger 21 is placed so as to be longer than it is wide. The direction in which air flows through the target air heat exchanger 21 is identical to the direction of air flow.

Thus, by using the fixing component 27, the target air heat exchanger 21 is fixed above the drain pan 26, which is a pullout drain pan. Here, as shown in FIG. 7, the dew dripping space S is formed. Accordingly, dew formed at the target air heat exchanger 21 and blown off by an air flow drips into the drain pan 26, which can suppress the dew from reaching the outside of the target air heat exchanger unit 20.

In the embodiment, the target air heat exchanger unit 20 includes the target air heat exchanger 21. The target air heat exchanger unit 20 includes the drain pan 26 provided below the target air heat exchanger 21. The target air heat exchanger unit 20 includes the unit housing 23 that houses the target air heat exchanger 21 and the drain pan 26 and that has the inlet side surface 23*a* and the outlet side surface 23*b*. The inlet side surface 23*a* has an open inlet from which air flows into the target air heat exchanger 21. The outlet side surface 23*b* is opposite to the inlet side surface 23*a* with the target air heat exchanger 21 disposed therebetween and has an open outlet from which air that has undergone heat exchange flows out. The drain pan 26 is a pullout drain pan capable of being pulled out sideways from the unit housing 23. The dew dripping space S is formed between the target air heat exchanger 21 and the outlet side surface 23*b* of the unit housing 23, and in the dew dripping space S, dew formed at the target air heat exchanger 21 and blown off by an air flow drips into the drain pan 26 due to its own weight before reaching the outlet. The target air heat exchanger unit 20 also includes the fixing component 27 by which the target air heat exchanger 21 is fixed to the outlet side surface 23*b* of the unit housing 23 without interfering with the lateral movement of the drain pan 26 and that forms the dew dripping space S between the target air heat exchanger 21 and the outlet side surface 23*b* of the unit housing 23.

In this configuration, not only can the target air heat exchanger 21 be installed above the drain pan 26, which is a pullout drain pan, without interfering with the drain pan 26, but it is also possible to suppress dew formed at the target air heat exchanger 21 and blown off by an air flow from reaching the outside of the target air heat exchanger unit 20 as the dew drips into the drain pan 26 due to its own weight. Thus, since blown-off dew does not reach the outside of the target air heat exchanger unit 20, the occurrence of mold outside the target air heat exchanger unit 20 and an undesirable effect, for example, corrosion of a component are not caused.

By using the fixing component 27, the target air heat exchanger 21 can be fixed to the outlet side surface 23*b* of the unit housing 23 in a state in which the target air heat exchanger 21 is spaced apart from the outlet side surface 23*b* of the unit housing 23 so as to form the dew dripping space S. Thus, to fix the target air heat exchanger 21, only the fixing component 27 should be provided. This can reduce the number of components, resulting in cost reduction.

In the embodiment, the fixing component 27 has the attachment portion 27*a* attached to the outlet side surface 23*b* of the unit housing 23. The fixing component 27 has the heat exchanger placement portion 27*b* in which the target air heat exchanger 21 is placed. The fixing component 27 has the laterally extending portion 27*c* extending laterally between the attachment portion 27*a* and the heat exchanger placement portion 27*b* so as to form the dew dripping space S.

In this configuration, as being made up of the attachment portion 27*a*, the heat exchanger placement portion 27*b*, and the laterally extending portion 27*c*, the fixing component 27 has a simple configuration. Thus, the fixing component 27 can be simply made, resulting in cost reduction. In addition, because of the provision of the laterally extending portion 27*c* extending laterally from one side to the other so as to form the dew dripping space S having the setting width L, merely by fixing the target air heat exchanger 21 to the fixing component 27, the dew dripping space S to be set inside the unit housing 23 can be formed in advance, which makes an assembly task easy.

In the embodiment, the heat exchanger placement portion 27*b* of the fixing component 27 has the opening 27*b*1 whose periphery matches the periphery of the target air heat exchanger 21. The heat exchanger placement portion 27*b* of the fixing component 27 has the right peripheral portion 27*b*2, the bottom peripheral portion 27*b*3, and the left peripheral portion 27*b*4 that are portions around the opening 27*b*1 and that extend around the target air heat exchanger 21.

In this configuration, the periphery of the opening 27*b*1 matches the periphery of the target air heat exchanger 21, which can suppress a decrease in efficiency of the target air heat exchanger 21.

The right peripheral portion 27*b*2, the bottom peripheral portion 27*b*3, and the left peripheral portion 27*b*4 are portions around the opening 27*b*1 and extend around the target air heat exchanger 21. The presence of these portions weakens the flow of air being diverted around the target air heat exchanger 21 without exchanging heat. Thus, even if the dew dripping space S is not large, dew blown off by the air flow being diverted around the target air heat exchanger 21 drips into the drain pan 26 due to its own weight before reaching the outlet surrounded by the flange 25.

In the embodiment, the attachment portion 27*a*, the heat exchanger placement portion 27*b*, and the laterally extending portion 27*c* of the fixing component 27 are made of the piece of sheet metal 27*d*.

In this configuration, the fixing component 27 can be formed of the piece of sheet metal 27*d*, which can reduce the number of manufacturing processes or manufacturing costs, resulting in cost reduction.

In the embodiment, the top plate 23*e* is a separate component of the unit housing 23.

In this configuration, an operator can remove the top plate 23*e* and can perform maintenance inside the target air heat exchanger unit 20.

In the embodiment, the laterally extending portion 27*c* of the fixing component 27 extends laterally from one side to the other above the target air heat exchanger 21. The attachment portion 27*a* of the fixing component 27 extends upward from the laterally extending portion 27*c* and is fixed under the top opening of the unit housing 23 from which the top plate 23*e* is removed.

In this configuration, the laterally extending portion 27*c* extends laterally from one side to the other above the target air heat exchanger 21. Thus, an air flow that is to be diverted around and flow above the target heat exchanger 21 is not generated although such an air flow is likely to blow off dew over a long distance. Thus, dew blown off by an air flow being diverted around the target air heat exchanger 21 drips into the drain pan 26 due to its own weight before reaching the outlet.

In addition, an operator can put his or her hands into the top opening of the unit housing 23 from which the top plate 23*e* is removed and fix the attachment portion 27*a* extending upward from the laterally extending portion 27*c* to the outlet side surface 23*b* of the unit housing 23 under the top opening of the unit housing 23. Thus, the operator can easily perform a task by putting his or her hands into the unit housing 23 and fix the fixing component 27, which makes the assembly task easy.

In the embodiment, the piece of sheet metal 27*d* is used to make the fixing component 27. The fixing component 27 has the opening 27*b*1 formed in the heat exchanger placement portion 27*b*. The fixing component 27 has the first bent portion 27*e* bent between the heat exchanger placement portion 27*b* and the laterally extending portion 27*c* along the first straight line in the direction orthogonal to the direction of air flow. The fixing component 27 has the second bent portion 27*f* bent between the laterally extending portion 27*c* and the attachment portion 27*a* along the second straight line in the direction orthogonal to the direction of air flow. The first bent portion 27*e* and the second bent portion 27*f* are bent in the opposite directions.

In this configuration, to make the fixing component 27, the opening 27*b*1 is formed in the piece of sheet metal 27*d*, and the piece of sheet metal 27*d* is bent twice along the first straight line and the second straight line so as to form the first bent portion 27*e* and the second bent portion 27*f*. This can reduce the number of manufacturing processes, resulting in cost reduction.

In the embodiment, the first bent portion 27*e* corresponds to the top periphery of the opening 27*b*1. The second bent portion 27*f* corresponds to the top periphery of the outlet having the same height as the top side of the periphery of the opening 27*b*1.

In this configuration, the top periphery of the opening 27*b*1 and the top periphery of the outlet surrounded by the flange 25 have the same height, and the laterally extending portion 27*c* extends laterally from one side to the other above the space between the opening 27*b*1 and the outlet. Thus, the flow of air is not blocked. Since the flow of air is not blocked, a decrease in air flow efficiency can be suppressed.

In the embodiment, the width (setting width L) of the dew dripping space S in the direction of air flow is from 5 cm to 15 cm, inclusive.

In this configuration, if the width (setting width L) of the dew dripping space S in the direction of air flow is less than 5 cm, blown-off dew reaches the outside of the target air heat exchanger unit 20. Meanwhile, if the width (setting width L) of the dew dripping space S in the direction of air flow is equal to or greater than 5 cm, blown-off dew does not reach the outside of the target air heat exchanger unit 20. However, if the width (setting width L) of the dew dripping space S in the direction of air flow exceeds 15 cm, the size of the target air heat exchanger unit 20 increases although it is possible to obtain the same effect of suppressing blown-off dew from reaching the outside of the target air heat exchanger unit 20. Meanwhile, if the width (setting width L) of the dew dripping space S in the direction of air flow is equal to or less than 15 cm, it is possible to downsize the target air heat exchanger unit 20 while obtaining an effect of suppressing blown-off dew from reaching the outside of the target air heat exchanger unit 20.

In the embodiment, the air-conditioning apparatus 30 includes the target air heat exchanger unit 20. The air-conditioning apparatus 30 includes the air-sending device unit 10 that accommodates the sirocco fan 11. In the air-conditioning apparatus 30, a refrigeration cycle circuit is formed by connecting the compressor 102, the heat-source-side heat exchanger 106, the expansion device 22, and the target air heat exchanger 21 to each other by the refrigerant pipe 120. The air-sending device unit 10 is provided on the upstream side of the target air heat exchanger unit 20 in the direction of the air flow generated by the sirocco fan 11.

In this configuration, dew formed at the target air heat exchanger 21 accommodated in the target air heat exchanger unit 20 can be suppressed from adhering to the sirocco fan 11 accommodated in the air-sending device unit 10.

In the embodiment, the air-sending device unit 10 and the target air heat exchanger unit 20 communicate with each other via the duct component 55 and thereby form the air duct 40 extending above the ceiling of a building or a house. The air-sending device unit 10 and the target air heat exchanger unit 20 are individually provided in the air duct 40 above the ceiling.

In this configuration, the air-sending device unit 10 and the target air heat exchanger unit 20 are individually installed in a space above the ceiling in which a task is difficult to perform. Thus, by providing the air-sending device unit 10 and the target air heat exchanger unit 20 as separate units, the installation of these units is facilitated. Moreover, as the duct component 55 can connect the air-sending device unit 10 and the target air heat exchanger unit 20 to each other, an assembly task is easily performed.

It should be noted that in the embodiment, the heat exchanger unit does not include an air-sending device. However, the present invention is not limited to this example. The heat exchanger unit may include an air-sending device.

REFERENCE SIGNS LIST

10 air-sending device unit 11 sirocco fan 11*a* air-sending port 12 controller 13 unit housing 14 flange 15 flange 20 target air heat exchanger unit 21 target air heat exchanger 21*a* holding portion 21*b* holding portion 21*c* holding portion 21*d* holding portion 22 expansion device 23 unit housing 23*a* inlet side surface 23*b* outlet side surface 23*c* right side surface 23*d* bottom surface 23*e* top plate 23*f* left side surface 24 flange 25 flange 26 drain pan 26*a* right side wall 26*b* water receiving surface 26*c* left side surface 26*d* drain hose 27 fixing component 27*a* attachment portion 27*b* heat exchanger placement portion 27*b*1 opening 27*b*2 right peripheral portion 27*b*3 bottom peripheral portion 27*b*4 left peripheral portion 27*c* laterally extending portion 27*d* sheet metal 27*e* first bent portion 27*f* second bent portion 28*a* screw hole 28*b* screw hole 29*a* screw hole 29*b* screw hole 29*c* screw hole 29*d* screw hole 30 air-conditioning apparatus 40 air duct 50 air-conditioned room 52 suction port 54 duct 55 duct component 56 duct 58 air outlet 60 equipment room 100 heat-source-side unit 102 compressor 104 flow-switching device 106 heat-source-side heat exchanger 108 air-sending device 110 controller 120 refrigerant pipe

The invention claimed is:

1. A heat exchanger unit comprising:

a heat exchanger;

a drain pan provided below the heat exchanger; and a housing that houses the heat exchanger and the drain pan and that has an inlet side surface and an outlet side surface opposite to the inlet side surface, the heat exchanger being disposed between the inlet side surface and the outlet side surface, the inlet side surface having an open inlet from which air flows into the heat exchanger, the outlet side surface having an open outlet from which air that has undergone heat exchange flows out, wherein:

the drain pan is a pullout drain pan capable of being pulled out sideways from the housing, a dew dripping space is formed between the heat exchanger and the outlet side surface of the housing, and in the dew dripping space, dew formed at the heat exchanger and blown off by an air flow drips into the drain pan due to its own weight before reaching the outlet, the heat exchanger unit further includes a fixing component by which the heat exchanger is fixed to the outlet side surface of the housing without interfering with lateral movement of the drain pan and that forms the dew dripping space between the heat exchanger and the outlet side surface of the housing, and the fixing component has:

an attachment portion attached to the outlet side surface of the housing, a heat exchanger placement portion in which the heat exchanger is placed, and a laterally extending portion that extends laterally between the attachment portion and the heat exchanger placement portion so as to form the dew dripping space, the heat exchanger placement portion extending along a length of the heat exchanger at a 90 degree angle longitudinally from the laterally extending portion.

2. The heat exchanger unit of claim 1, wherein the heat exchanger placement portion of the fixing component has an opening whose periphery matches a periphery of the heat exchanger and has a peripheral portion around the opening, the peripheral portion extending around the heat exchanger.

3. The heat exchanger unit of claim 1, wherein the attachment portion, the heat exchanger placement portion, and the laterally extending portion of the fixing component are formed of a piece of sheet metal.

4. The heat exchanger unit of claim 1, wherein the housing has a top plate as a separate component.

5. The heat exchanger unit of claim 4, wherein:

the laterally extending portion of the fixing component extends laterally from one side to an other side above the heat exchanger, and the attachment portion of the fixing component extends upward from the laterally extending portion and is fixed under a top opening of the housing from which the top plate is removed.

6. The heat exchanger unit of claim 5, wherein:

the fixing component is made of a piece of sheet metal and has the opening formed in the heat exchanger placement portion, a first bent portion, and a second bent portion, the first bent portion being bent between the heat exchanger placement portion and the laterally extending portion along a first straight line in a direction orthogonal to a direction of air flow, the second bent portion being bent between the laterally extending portion and the attachment portion along a second straight line in the direction orthogonal to the direction of air flow, and the first bent portion and the second bent portion are bent in opposite directions.

7. The heat exchanger unit of claim 6, wherein:

the first bent portion corresponds to a top periphery of the opening, and the second bent portion corresponds to a top periphery of the outlet having the same height as a top side of a periphery of the opening.

8. The heat exchanger unit of claim 1, wherein a width of the dew dripping space in a direction of air flow is from 5 cm to 15 cm, inclusive.

9. An air-conditioning apparatus comprising:

the heat exchanger unit of claim 1; and an air-sending device unit that accommodates an air-sending device, wherein:

a refrigeration cycle circuit is formed by connecting a compressor, a heat-source-side heat exchanger, an expansion device, and the heat exchanger to each other by a pipe, and the air-sending device unit is provided on an upstream side of the heat exchanger unit in a direction of an air flow generated by the air-sending device.

10. The air-conditioning apparatus of claim 9, wherein:

the air-sending device unit and the heat exchanger unit communicate with each other via a duct component and thereby form an air duct extending above a ceiling of a building or a house, and the air-sending device unit and the heat exchanger unit are individually provided in the air duct above the ceiling.

11. The air-conditioning apparatus of claim 1, wherein the heat exchanger placement portion extending along the length of the heat exchanger is an extending along an entire length of the heat exchanger.

* * * * *